US008366915B2

(12) United States Patent
Goliaszewski et al.

(10) Patent No.: US 8,366,915 B2
(45) Date of Patent: Feb. 5, 2013

(54) METHOD FOR REMOVING CALCIUM FROM CRUDE OIL

(75) Inventors: Alan E. Goliaszewski, The Woodlands, TX (US); David B. Engel, The Woodlands, TX (US); Roger C. May, Warminster, PA (US)

(73) Assignee: General Electric Company, Schenectady, NY (US)

( * ) Notice: Subject to any disclaimer, the term of this patent is extended or adjusted under 35 U.S.C. 154(b) by 292 days.

(21) Appl. No.: 12/215,340

(22) Filed: Jun. 26, 2008

(65) Prior Publication Data

US 2008/0264830 A1 Oct. 30, 2008

Related U.S. Application Data

(63) Continuation of application No. 11/292,532, filed on Dec. 2, 2005, now abandoned.

(51) Int. Cl.
*C10G 17/04* (2006.01)
*C10G 29/26* (2006.01)

(52) U.S. Cl. ..... 208/252; 208/251 R; 208/282; 210/701

(58) Field of Classification Search ..... 208/251 R, 208/253, 252, 282; 210/701; 252/180; 524/807, 524/817, 832
See application file for complete search history.

(56) References Cited

U.S. PATENT DOCUMENTS

| | | | | |
|---|---|---|---|---|
| 4,647,381 | A | 3/1987 | Fong | |
| 4,778,589 | A * | 10/1988 | Reynolds | 208/252 |
| 6,444,747 | B1 * | 9/2002 | Chen et al. | 524/807 |
| 6,627,590 | B1 * | 9/2003 | Sherry et al. | 510/238 |
| 2004/0045875 | A1 * | 3/2004 | Nguyen et al. | 208/251 R |
| 2005/0067324 | A1 | 3/2005 | Kuehne et al. | |
| 2005/0241996 | A1 * | 11/2005 | Garcia et al. | 208/251 R |

FOREIGN PATENT DOCUMENTS

| | | | |
|---|---|---|---|
| EP | 0735126 | | 10/1996 |
| JP | 60-118295 | A | 6/1985 |
| JP | 61-153199 | A | 7/1986 |
| JP | 63-159493 | A | 6/1988 |
| JP | 2004-528439 | A | 9/2004 |
| WO | 0052114 | | 9/2000 |
| WO | WO 2004-020553 | A1 | 3/2004 |
| WO | 2005028592 | | 3/2005 |

OTHER PUBLICATIONS

Japanese Office Action issued Feb. 14, 2002 in related Japanese Patent Application 2009-517535A published Apr. 30, 2009.

International Search Report, dated Apr. 5, 2007, in related PCT application No. PCT/US2006/045518.

* cited by examiner

*Primary Examiner* — Walter D Griffin

*Assistant Examiner* — Renee E Robinson

(74) *Attorney, Agent, or Firm* — Wegman, Hessler & Vanderburg

(57) ABSTRACT

Methods for reducing calcium deposition along surfaces in contact with the water phase of a resolved water/oil emulsion are disclosed. High calcium crude oil and the like are contacted with a sequestrant to form a sequestered calcium containing complex that partitions to the water phase in the resolved emulsion. A specifically formulated polymeric deposit control agent is added to the water phase to inhibit calcium deposit formation therein and along surfaces in contact with the water phase.

6 Claims, No Drawings

METHOD FOR REMOVING CALCIUM FROM CRUDE OIL

CROSS REFERENCE TO RELATED APPLICATION

This application is a continuation of U.S. patent application Ser. No. 11/292,532 filed Dec. 2, 2005 now abandoned.

FIELD OF INVENTION

The invention pertains to improved methods for removing calcium from a hydrocarbonaceous medium via extraction by a sequestrant. The sequestrant, when added to the hydrocarbonaceous medium, results in the formation of a calcium complex that partitions to the water phase as the hydrocarbonaceous medium is brought in contact with an aqueous wash phase. A specifically formulated deposit control agent is brought into contact with the water phase to control calcium based deposit formation.

BACKGROUND OF THE INVENTION

All crude oil contains impurities which contribute to corrosion, heat exchanger fouling, furnace coking, catalyst deactivation, and product degradation in refinery and other processes. These contaminants are broadly classified as salts, bottom sediment, and water (BS+W), solids, and metals. The amounts of these impurities vary, depending upon the particular crude. Generally, crude oil salt content ranges between about 3-200 pounds per 1,000 barrels (ptb).

Brines present in crude include predominately sodium chloride with lesser amounts of magnesium chloride and calcium chloride being present. Chloride salts are predominantly the source of highly corrosive HCl, which is severely damaging to refinery tower trays and other equipment. Additionally, carbonate and sulfate salts may be present in the crude in sufficient quantities to promote crude preheat exchanger scaling.

Solids other than salts are equally harmful. For example, sand, clay, volcanic ash, drilling muds, rust, iron sulfide, metal, and scale may be present and can cause fouling, plugging, abrasion, erosion and residual product contamination. As a contributor to waste and pollution, sediment stabilizes emulsions in the form of oil-wetted solids and can carry significant quantities of oil into the waste recovery systems.

Metals in crude may be inorganic or organometallic compounds which consist of hydrocarbon combinations with arsenic, vanadium, nickel, copper, and iron. These materials promote fouling and can cause catalyst poisoning in subsequent refinery processes, such as catalytic cracking methods, and they may also contaminate finished products. The majority of the metals carry as bottoms in refinery processes. When the bottoms are fed, for example, to coker units, contamination of the end-product coke is most undesirable. For example, in the production of high grade electrodes from coke, iron contamination of the coke can lead to electrode degradation and failure in processes, such as those used in the chlor-alkali industry.

Desalting is, as the name implies, a process that is adapted to remove primarily inorganic salts from the crude prior to refining. The desalting step is provided by adding and mixing with the crude a few volume percentages of fresh water to contact the brine and salt. In crude oil desalting, a water in oil (W/O) emulsion is intentionally formed with the water admitted being on the order of about 4-10 volume % based on the crude oil. Water is added to the crude and mixed intimately to transfer impurities in the crude to the water phase. Separation of the phases occurs due to coalescence of the small water droplets into progressively larger droplets and eventual gravity separation of the oil and underlying water phase.

Demulsification agents are added, usually upstream from the desalter, to help in providing maximum mixing of the oil and water phases in the desalter, and gently increase the speed of water break. Known demulsifying agent include water soluble salts, sulfonated glycerides, sulfonated oils, alkoxylated phenol formaldehyde resins, polyols, copolymers of ethylene oxide and propylene oxide, a variety of polyester materials, and many other commercially available compounds.

Desalters are also commonly provided with electrodes to impart an electrical field in the desalter. This serves to polarize the dispersed water molecules. The so-formed dipole molecules exert an attractive force between oppositely charged poles with the increased attractive force increasing the speed of water droplet coalescence by from ten to one hundred fold. The water droplets also move quickly in the electrical field, thus promoting random collisions that further enhance coalescence.

Upon separation of the phases from the W/O emulsions, the crude is commonly drawn off the top of the desalter and sent to the fractionator tower in crude units or other refinery processes. The water phase may be passed through heat exchanges or the like and ultimately is discharged as effluent.

Calcium removal has become an important concern over the last few years due to increasing use of crudes with very high levels of calcium (such as some from the African continent that contain over 200 ppm, and some nearly 400 ppm of calcium). Previously, the highest calcium content was only 50 ppm. Extraction of the calcium salts via the desalting process is stymied when the calcium is associated with naphthenic acids (high TAN (Total Acid Number) crudes). These calcium naphthenates are not water extracted and stay with the oil phase. Problems for the refiners associated with high calcium include exceeding metal specs for fuels oils that have resids blended in, poisoning catalysts for residual catalytic crackers, adversely affecting coke specs for metals, and contributing to crude unit fouling and delayed coker furnace fouling.

Several methods have been disclosed for the removal of calcium from crude oil, essentially using the desalter. All involve the use of organic carboxylic acids (supposedly to protonate the naphthenic acids and extract the calcium into the wash water). Reynolds (U.S. Pat. No. 4,778,589) teaches the use of hydroxycarboxylic acids, such as citric acid, added to the wash water to effect the calcium extraction in the desalter. Roling (U.S. Pat. No. 5,078,858) improved on this process by the addition of citric acid to the crude oil phase for enhanced extraction rates of metals. Both patents discuss the modification of the wash water pH for better extraction. Lindemuth (U.S. Pat. No. 5,660,717) describes the use of functionalized polymers of acrylic acid for cation removal. Nguyen (U.S. Published Patent Application 2004/0045875) describes the use of alpha-hydroxy carboxylic acid (particularly glycolic acid) for the removal of calcium and amines.

The method of Reynolds, while likely successful at the extraction of low levels of calcium (<30 ppm), has two significant drawbacks which make it impractical for use with the high calcium crudes. One is that since the extraction process is stoichiometric, at the high levels of citric acid needed in the wash water, its pH drops significantly (to below 3) and causes a corrosion issue in the wash water circuit. This can be alleviated by the use of corrosion inhibitors.

A second concern is that the concentration of the resultant calcium citrate has a solubility limitation of approximately 1000 ppm at room temperature, and pH of 6-8 with solubility inversely correlated with temperature. Thus, one can see that deposition of calcium citrate is an issue at typical desalter temperatures (250° F.-300° F.) and concentrations encountered when extracting higher levels of calcium with the typical 5% wash water rate. In fact, both of these concerns were verified through field experience with citric acid at a refinery processing significant levels of a high calcium crude. Deposition in the brine heat exchanger and transfer piping was one of the problems that was experienced.

SUMMARY OF THE INVENTION

The invention pertains to a combination of treatment chemistries to overcome the deficiencies of the Reynolds patent. In one aspect, the invention pertains to the use of a sequestrant to effect sequestration of the calcium from the hydrocarbonaceous medium to the water phase of the W/O emulsion combined with contact of the water phase by a specifically formulated deposited control polymer to thereby inhibit the formation of calcium based scales and deposits in the water phase and along refinery system surfaces in contact with the water phase. Examples of such surfaces include drains, drain lines, desalter vessels, mix valves, static mixers, and heat exchangers that are in contact with the brine (i.e., water phase).

In a more specific aspect of the invention, citric acid or its salts are used as the sequestrant, and the sequestered calcium containing complex is calcium citrate. The deposit control polymer inhibits calcium citrate scale formation in the water phase and along surfaces that contact the water phase. While calcium citrate scale control is important, the treatment should also not adversely affect desalter operation (longer water drop rates, etc.).

DETAILED DESCRIPTION OF EXEMPLARY EMBODIMENTS

Although the present invention is primarily described in conjunction with its use in a conventional desalter operation, the artisan will appreciate that other extraction techniques will also benefit from the invention. One example is countercurrent extraction, wherein an aqueous phase is brought into contact with an oppositely flowing hydrocarbonaceous medium.

Further, although the invention is particularly advantageous in removing calcium from crude oil, the phrase "liquid hydrocarbonaceous medium" should be construed to include other media such as bitumens, atmospheric or vacuum residia or solvent deasphalted oils derived from crudes and residua that are hydroprocessed or cracked into useable products such as gas oils, gasolines, diesel fuel, and shale oil, liquefied coal, beneficiated tar sand, etc. Also, emulsions including such hydrocarbonaceous media or any hydrocarbonaceous product are included within the ambit of this phrase.

High calcium containing crudes are, as used herein, crudes containing greater than about 30 ppm calcium therein relative to one million parts of the crude or other liquid hydrocarbonaceous media. The invention will be particularly beneficial to those crudes having greater than about 100 ppm calcium and higher.

Also, the phrase "sequestered calcium containing complex" as used throughout the specification and claims covers a host of chelated, complexed, or sequestered complexes or ligands, or other species including ionic or covalent compounds in which calcium is extracted from the oil phase and, at least in part, partitions to the water phase in a desalter or other extraction process. For example, when citric acid or one of its salt forms is used as the sequestering agent, calcium citrate is the resulting sequestered calcium containing complex that at least partially partitions to the water phase upon resolution of the W/O emulsion.

As to the sequestrants that are to be added either to the oil phase or water phase to contact the high calcium crude, these are fed in at least stoichiometric amounts relative to the moles of calcium in the crude. Exemplary sequestrants include the carboxylic acid sequestrants with more preferred sequestrants including those containing plural COOH functionality such as the dibasic carboxylic acids including oxalic, malonic, succinic, maleic, and adipic acid. Most preferred are the hydroxycarboxylic acids such as citric and tartaric acids and their salts.

In one exemplary embodiment of the invention, the liquid hydrocarbon medium is intimately and thoroughly mixed with an aqueous solution of citric acid or its salt. The calcium in the liquid hydrocarbon combines with the sequestrant to form a water soluble or dispersible complex in the aqueous phase. A deposit control polymer I, as described hereinafter, is brought into contact with the complex, such as by adding it to the water phase. The aqueous phase and hydrocarbon phase separate upon resolution of the W/O emulsion, with the separated hydrocarbon phase being available for distillation or hydroprocessing.

Turning now to the copolymer and terpolymers that are used to inhibit calcium based scale and deposit formation, these are represented by the following Formula I:

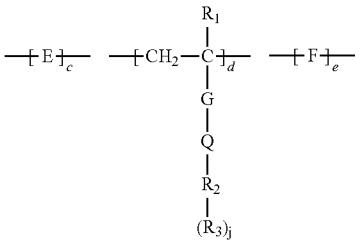

(I)

wherein E is the repeat unit remaining after polymerization of an ethylenically unsaturated compound; preferably a carboxylic acid, sulfonic acid, phosphonic acid, or amide form thereof; $R_1$ is H or lower ($C_1$-$C_6$) alkyl; G is lower ($C_1$-$C_6$) alkyl or carbonyl; Q is O or NH; $R_2$ is lower ($C_1$-$C_6$) alkyl; hydroxy lower ($C_1$-$C_6$) alkyl, lower ($C_1$-$C_6$) alkyl sulfonic acid, -(Et-O)—$_n$, -(iPr—O)—$_n$ or —(Pr—O)—$_n$ wherein n ranges from about 1 to 100, preferably 1 to 20, and $R_3$ is H, or XZ wherein X is an anionic radical selected from the group consisting of $SO_3$, $PO_3$ or COO; Z is H or hydrogens or any other water soluble cationic moiety which counterbalances the valence of the anionic radical X, including but not limited to Na, K, Ca, $NH_4$; j is 0 or 1.

F, when present, is a repeat unit having the Formula II:

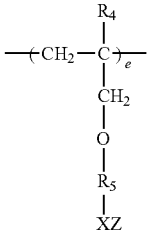

(II)

wherein X and Z are the same as in Formula I. $R_4$ is H or ($C_1$-$C_6$) lower alkyl, $R_5$ is a hydroxy substituted alkyl or alkylene radical having from 1 to 6 atoms, and XZ may or may not be present.

Subscripts c, d, and e in Formula I are the molar ratio of the monomeric repeating unit. The ratio is not critical to the present invention provided that the copolymer or terpolymer is water soluble or water dispersible. Subscripts c and d are positive integers, while subscript e is a non-negative integer. That is, c and d are integers of 1 or more, while e can be 0, 1, 2, etc.

With respect to E of Formula I, it may comprise the repeat unit obtained after polymerization of a carboxylic acid, sulfonic acid, phosphonic acid, or amide form thereof or mixtures thereof. Exemplary compounds include but are not limited to the repeat unit remaining after polymerization of acrylic acid, methacrylic acid, acrylamide, methacrylamide, N-methyl acrylamide, N,N-dimethyl acrylamide, N-isopropylacrylamide, maleic acid or anhydride, fumaric acid, itaconic acid, styrene sulfonic acid, vinyl sulfonic acid, isopropenyl phosphonic acid, vinyl phosphonic acid, vinylidene di-phosphonic acid, 2-acrylamido-2-methylpropane sulfonic acid and the like and mixtures thereof. Water-soluble salt forms of these acids are also within the purview of the present invention. More than one type of monomer unit E may be present in the polymer of the present invention.

Exemplary copolymers and terpolymers encompassed by the formula include:

1) acrylic acid/allyl-2-hydroxy propyl sulfonate ether, (i.e., AA/AHPSE);
2) acrylic acid/allyl polyethyleneoxide sulfate ether, (i.e., AA/APES);
3) acrylic acid/2-acrylamido-2-methyl-1-propane sulfonic acid, (i.e., AA/AMPS);
4) acrylic acid/ammonium allylpolyethoxy sulfate/alloxy-2-hydroxypropane-3-sulfonic acid terpolymer (i.e., AA/APES/AHPSE);
5) acrylic acid/methacrylic acid/ammonium allylpolyethyoxy (10) sulfate terpolymers (i.e., AA/MA/APES);
6) acrylic acid/2-acrylamido-2-methylpropane sulfonic acid/ammonium allylpolyethoxy sulfate terpolymers (i.e., AA/AMPS/APES).

The polymerization of the copolymer and/or terpolymer (I) may proceed in accordance with solution, emulsion, micelle or dispersion polymerization techniques. Conventional polymerization initiators such as persulfates, peroxides, and azo type initiators may be used. Polymerization may also be initiated by radiation or ultraviolet mechanisms. Chain transfer agents including alcohols, such as isopropanol or allyl alcohol, amines, mercapto compounds or hypophosphorous acid may be used to regulate the molecular weight of the polymer. One particularly preferred method is to employ hypophosphorous acid as the chain transfer agent in amount such that a small portion thereof remains in the polymer backbone (i.e., from about 0.01-5 wt %). Branching agents, such as methylene biscrylamide, or polyethylene glycol diacrylate and other multifunctional crosslinking agents may be added. The resulting polymer may be isolated by precipitation or other well-known techniques. If polymerization is in the aqueous solution, the polymer may simply be used in the aqueous solution form.

The molecular weight of the water-soluble copolymer of Formula I is not critical but preferably falls within the range Mw of about 1,000 to 1,000,000; more preferably, from about 1,000 to 50,000 and most preferably from about 1,500 to 25,000. The essential criteria is that the polymer be water-soluble or water dispersible.

The metal sequestering agent may be brought into contact with the liquid hydrocarbon medium either by adding the sequestrant to the liquid hydrocarbon medium or to the water wash in the desalter. As above indicated, contact of the hydrocarbon medium with the sequestrant forms a sequestered calcium containing complex that, at least in part, partitions to the water phase upon resolution of the water in oil emulsion in the desalter or other extraction process.

The polymer I may be brought into direct contact with the resolved water phase or it can be intimately dispersed in the hydrocarbon medium so as to effect contact with the aqueous phase upon the mixing of the liquid hydrocarbon medium and the aqueous medium in the desalter. From about 1-300 ppm of the polymer are admitted based upon one million parts of the water phase. More preferably, from about 1-100 ppm of polymer I are admitted to the aqueous medium.

As in conventional desalter apparatuses, the emulsion may be heated to about 100° F.-300° F., an and electrical potential may be impressed across the emulsion to enhance the separation. Utilization of the polymer I helps to inhibit calcium based deposition or scale that would otherwise form in the water phase or along surfaces in contact therewith, such as drains, conduit lines, brine heat exchangers, desalter vessel, mix valves, static mixers, and the like.

As mentioned, the removal of salts and solids from crude oil is traditionally performed at a refinery site that has installed the appropriate equipment for washing the crude oil with water (i.e., the desalter). Oil production sites generally only have separation equipment to separate native or produced water and leave the final salts removal to the refineries. In accordance with the invention, salt removal can also be advantageously performed at the site of the oil production. This may involve installation of equipment such as desalters, but would result in a uniform improvement of the produced oil and generation of a higher value product.

Conventional emulsion breakers may be added to the crude so as to enhance resolution of the emulsion. These emulsion breakers are, in most part, surfactants that migrate to the oil/water interface and alter the surface tension of the interfacial layer allowing droplets of water or oil to coalesce more readily. These emulsion breakers reduce the residence time required for good separation of oil and water. Addition of scale inhibitor should additionally not materially interfere with the performance of the emulsion breaker. Additionally, conventional corrosion inhibiting agents may be added to either the water or oil phase or both to inhibit desalter corrosion and corrosion that may otherwise occur in downstream hydroprocessing and/or water treatment processes.

It is not obvious that the polymers (I) would be effective in inhibiting calcium citrate scale. For example, as will be shown in the following examples, several known calcium carbonate scale inhibition agents, such as polyacrylic acid, HEDP (1-hydroxyethyl-1,1-diphosphonic acid) and NTA (nitrilo triacetic acid), had little or no effect on inhibiting calcium citrate formation.

It is thus been discovered that a family of polymers, namely polymer (I), inhibits the deposition of calcium citrate and allows significantly higher levels to be formed at elevated temperatures prior to deposition. The invention represents complementary technology that allows citric acid or other sequestrants to be used in extracting high concentrations of calcium from crude oil.

The invention will now be further described with reference to the following specific examples which are to be regarded solely as illustrative and not as restricting the scope of the invention.

EXAMPLES

Example 1

In order to assess the efficacy of various candidate materials in inhibiting calcium citrate crystal formation, a solution (solution A) of 1,000 ppm (as solids) calcium chloride, and 1,000 ppm (as solids) citric acid was prepared. NaOH was added to bring the pH up to 7.1. Treated and untreated solutions were heated at 100° C. for 1-1.5 hours. Results are shown in Table 1.

TABLE 1

| | Treatment | Observations |
|---|---|---|
| 1 | 100 ml solution A: untreated | A lot of fine crystals precipitated on bottom (assumed 100%). The water is clear. |
| 2 | 100 ml solution A + sulfuric acid dilution to have pH 5.1 | About 25% (compare to the untreated) crystallize growing. The water is clear. |
| 3 | 100 ml solution A + sulfuric acid dilution to have pH 6.1 | About 40% (compare to the untreated) crystallize growing. The water is clear. |
| 4 | 100 ml solution A + 50 ppm active HEDP (DeQuest 2010) | A lot of fine and floc precipitate. The water is cloudy. |
| 5 | 100 ml solution A + 50 ppm active NTA | A few (<2-5%) crystals on bottom. The water is clear. |

TABLE 1-continued

| | Treatment | Observations |
|---|---|---|
| 6 | 100 ml solution A + 50 ppm Comparative Product AA | A lot of fine and floc precipitate. The water is cloudy. |

HEDP = hydroxy ethylidene diphosphonic acid

NTA = nitrilotriacetic acid

Comparative Product AA = polyacrylic acid homopolymer nominal molecular weight about 5,000.

Example 2

Additional tests utilizing the procedure of Example 1 were conducted. Results are reported in Table 2.

TABLE 2

| | Treatment | Observations |
|---|---|---|
| 2.1 | 100 ml solution A: untreated | A lot of fine crystals precipitated on bottom (assumed 100%). The water is clear. |
| 2.2 | 100 ml solution A + 10 ppm active NTA | A lot of fine crystals precipitated on bottom (about 100%). The water is clear. |
| 2.3 | 100 ml solution A + 20 ppm active NTA | A lot of fine crystals precipitated on bottom (about 60%). The water is clear. |
| 2.4 | 100 ml solution A + 30 ppm active NTA | Lesser fine crystals precipitated on bottom (about 30%). The water is clear. |
| 2.5 | 100 ml solution A + 40 ppm active NTA | About 5% crystals on bottom. The water is clear. |
| 2.6 | 100 ml solution A + 50 ppm active NTA | Very few crystals on bottom. The water is clear. |

Example 3

Further tests utilizing the procedure of Example 1 were undertaken. Results are shown in Table 3.

TABLE 3

| | Treatment | Observations |
|---|---|---|
| 3.1 | 100 ml solution A: untreated | A lot of fine crystals precipitated on bottom (assumed 100%), the water is clear water. 0.0595 g crystals |
| 3.2 | 100 ml solution A + 35 ppm active NTA | About 5-10% crystals on bottom. The water is clear. |
| 3.3 | 100 ml solution A + 35 ppm active EDTA-free acid | About 5-10% crystals on bottom. The water is clear. |
| 3.4 | 100 ml solution A + 70 ppm Product A | Clean and clear water. No crystals. |
| 3.5 | 100 ml solution A + 70 ppm Product B | Clean and clear water. No crystals. |
| 3.6 | 100 ml solution A + 70 ppm Product PBTC | About 5-10% crystals on bottom. The water is clear. |
| 3.7 | 100 ml solution A + 70 ppm Product DeQuest 2060 | No crystals observed, but the water is cloudy. |
| 3.10 | 100 ml solution A + 30 ppm Product A | Clean and clear water. No crystals. |
| 3.11 | 100 ml solution A + 50 ppm Product A | Clean and clear water. No crystals. |
| 3.12 | 100 ml solution A + 70 ppm Product A | Clean and clear water. No crystals. |
| 3.13 | 100 l solution A + 30 ppm Product B | Clean and clear water. No crystals. |
| 3.14 | 100 ml solution A + 50 ppm Product B | Clean and clear water. No crystals. |
| 3.15 | 100 ml solution A + 70 ppm Product B | Clean and clear water. No crystals. |
| 3.16 | 100 ml untreated Solution A | A lot of fine crystals precipitated on bottom (assumed 100%), the water is clear water. 0.0644 g crystals |

PBTC = 2-phosphonobutane 1,2,4-tricarboxylic acid

DeQuest 2060 = diethylene triaminopenta(methylene phosphonic acid)

Product A = acrylic acid/allyl-2-hydroxypropylsulfonate ether (AHPSE); 36.5% active; nominal mw about 25,000 AA:AAPSE = 3 to 1

Product B = acrylic acid/allyl polyethoxy (10) sulfate ether (APES); % active about 30%; nominal mw about 15,000, AA:APES = 3:1

Example 4

Additional tests were undertaken using the procedure of Example 1. Test results are shown in Table 4.

TABLE 4

| | Treatment | Observations |
|---|---|---|
| 1* | 100 ml of solution A: untreated | A lot of fine crystals precipitated on bottom (assumed 100%), the water is clear water. 0.0692 g crystals |
| 2 | 100 ml solution A + 5 ppm Product A | About 5% crystal on bottom. The water is clear. |
| 3 | 100 ml solution A + 10 ppm Product A | No crystals. Clear water. |
| 4 | 100 ml solution A + 20 ppm Product A | No crystals. Clear water. |

TABLE 4-continued

| | Treatment | Observations |
|---|---|---|
| 5 | 100 ml solution A + 5 ppm Product B | About 5-10% crystals on bottom. The water is clear. |
| 6 | 100 ml solution A + 10 ppm Product B | About 2-5% crystals on bottom. The water is clear |
| 7 | 100 ml solution A + 20 ppm Product B | No crystals. Clear water. |
| 8 | 100 ml solution A + 20 ppm active EDTA-free acid | About 10-20% crystals on bottom. Clear water. |
| 9 | 100 ml solution A + 20 ppm active NTA | About 10-20% crystals on bottom. Clear water. |

1* The solution was filtered through a Teflon filter and submitted to oil lab for Ca citrate determination. The analysis has confirmed that it was calcium citrate.

Example 5

In order to assess the impact of the calcium citrate deposit inhibition chemistry on desalter operations, simulations were conducted on high $Ca^{2+}$ test crudes in a simulated desalter apparatus.

The simulated desalter comprises an oil bath reservoir provided with a plurality of test cell tubes disposed therein. The temperature of the oil bath can be varied to about 300° F. to simulate actual field conditions. Electrodes are operatively connected to each test cell to impart an electric field of variable potential through the test emulsions contained in the test cell tubes.

95 ml of high calcium containing crude oil (110 ppm $Ca^{2+}$) and 5 ml D.I. water were admitted to each test cell along with the candidate treatment materials. The crude/water/treatment mixtures were homogenized by mixing at 13 psi (13,000 rpm/2 sec) and the crude/water/treatment mixtures were heated to about 250° F. After 32 minutes, 75 ml of the top crude was collected from each cell for calcium analysis. Water drop (i.e., water level) in ml was observed for each sample after predetermined time intervals.

Results are shown in Table 5.

TABLE 5

| | | | Water Drop Reading in MI | | | | | | | Interface (I/F) | Ca Result in |
|---|---|---|---|---|---|---|---|---|---|---|---|
| | | | 1 min | 2 min | 4 min | 8 min | 16 min | 32 min | Mean WD | & Brine | Oil Phase |
| 5.1 | 8 ppm 2W158 to oil<br>1000 ppm citric acid to water | 40 µl (2%)<br>50 µl (10%) | 3.5 | 4 | 4.5 | 5 | 5 | 5 | 4.50 | Good I/F, clear water | 10.9 ppm |
| 5.2 | 8 ppm 2W158 to oil<br>1600 ppm citric acid to water | 40 µl (2%)<br>80 µl (10%) | 3.7 | 4 | 4.5 | 5 | 5 | 5 | 4.53 | 1 ml emulsion clear water | 11.7 ppm |
| 5.3 | 8 ppm 2W158 to oil<br>1000 ppm citric acid to water<br>300 ppm Product A to water | 40 µl (2%)<br>50 µl (10%)<br>75 µl (2%) | 0.4 | 1 | 1.6 | 2.5 | 3.5 | 4 | 2.17 | 2 ml emulsion clear water | 12.3 ppm |
| 5.4 | 8 ppm 2W158 to oil<br>1600 ppm citric acid to water<br>300 ppm Product A to water | 40 µl (2%)<br>80 µl (10%)<br>75 µl (2%) | 0.4 | 0.8 | 1.4 | 2 | 2.5 | 3 | 1.68 | 2 ml emulsion clear water | 11.0 ppm |
| 5.5 | 8 ppm 2W158 to oil<br>1000 ppm citric acid to water<br>400 ppm Product B to water | 40 µl (2%)<br>50 µl (10%)<br>100 µl (2%) | 0.4 | 0.6 | 1.2 | 2.5 | 3 | 3.5 | 1.87 | 2 ml emulsion clear water | 12.2 ppm |
| 5.6 | 8 ppm 2W158 to oil<br>1600 ppm citric acid to water<br>400 ppm Product B to water | 40 µl (2%)<br>80 µl (10%)3<br>100 µl (2%) | 0.2 | 0.4 | 1 | 1.6 | 1.8 | 2.5 | 1.25 | 2 ml emulsion clear water | 13.6 ppm |
| 5.7 | 8 ppm 2W158 to oil<br>1000 ppm citric acid to water<br>800 ppm NTA to water | 40 µl (2%)<br>50 µl (10%)<br>200 µl (2%) | 3 | 3.5 | 4.5 | 5 | 5 | 5 | 4.33 | Good I/F, clear Water | 13.3 ppm |
| 5.8 | 8 ppm 2W158 to oil<br>1000 ppm citric acid to water<br>800 ppm EDTA to water | 40 µl (2%)<br>50 µl (10%)<br>200 µl (2%) | 3.5 | 4 | 4.5 | 5 | 5 | 5 | 4.50 | Good I/F, clear Water | 9.9 ppm |
| 5.9 | 10 ppm 2W158 to oil<br>1000 ppm citric acid to water<br>300 ppm Product A to water | 50 µl (2%)<br>50 µl (10%)<br>75 µl (2%) | 0.4 | 0.6 | 1.2 | 2.7 | 3.5 | 3.7 | 2.02 | 2 ml emulsion clear water | N/A |
| 5.10 | 20 ppm 2W158 to oil<br>1000 ppm citric acid to water<br>300 ppm Product A to water | 100 µl (2%)<br>50 µl (10%)<br>75 µl (2%) | 0.8 | 1.2 | 2.5 | 3.7 | 4.5 | 5 | 2.95 | Good I/F, clear Water | 10.4 ppm |
| 5.11 | 30 ppm 2W158 to oil<br>1000 ppm citric acid to water<br>300 ppm Product A to water | 150 µl (2%)<br>50 µl (10%)<br>75 µl (2%) | 1 | 2 | 3.5 | 4.5 | 5 | 5 | 3.50 | Good I/F, clear Water | 10.4 ppm |
| 5.12 | 40 ppm 2W158 to oil<br>1000 ppm citric acid to water<br>300 ppm Product A to water | 200 µl (2%)<br>50 µl (10%)<br>75 µl (2%) | 2.5 | 3.5 | 4.7 | 5 | 5 | 5 | 4.28 | Good I/F, clear Water | 12.4 ppm |
| 5.13 | 8 ppm 2W158 to oil<br>1000 ppm citric acid to water | 40 µl (2%)<br>50 µl (10%) | 4 | 4.5 | 5 | 5 | 5 | 5 | 4.75 | Good I/F Clear water | |
| 5.14 | 8 ppm 2W158 to oil<br>1000 ppm citric acid to water<br>150 ppm WS 55 to water | 40 µl (2%)<br>50 µl (10%)<br>37.5 µl (2%) | 4 | 4.5 | 5 | 5 | 5 | 5 | 4.75 | Good I/F Slightly cloudy water | |
| 5.15 | 8 ppm 2W158 to oil<br>1000 ppm citric acid to water<br>300 ppm WS 55 to water | 40 µl (2%)<br>50 µl (10%)<br>75 µl (2%) | 4 | 4.5 | 5 | 5 | 5 | 5 | 4.75 | Good I/F Slightly cloudy water | |
| 5.16 | 8 ppm 2W158 to oil<br>1000 ppm citric acid to water<br>15 ppm Product A to water | 40 µl (2%)<br>50 µl (10%)<br>3.75 µl (2%) | 4 | 4.5 | 5 | 5 | 5 | 5 | 4.75 | Good I/F Clear water | |
| 5.17 | 8 ppm 2W158 to oil<br>1000 ppm citric acid to water<br>15 ppm Product A to water<br>150 ppm WS 55 to water | 40 µl (2%)<br>50 µl (10%)<br>3.75 µl (2%)<br>37.5 µl (2%) | 4 | 4.5 | 5 | 5 | 5 | 5 | 4.75 | Good I/F Slightly cloudy water | |

TABLE 5-continued

| | | | Water Drop Reading in MI | | | | | | | Interface (I/F) | Ca Result in |
|---|---|---|---|---|---|---|---|---|---|---|---|
| | | | 1 min | 2 min | 4 min | 8 min | 16 min | 32 min | Mean WD | & Brine | Oil Phase |
| 5.18 | 8 ppm 2W158 to oil | 40 µl (2%) | 4 | 4.5 | 5 | 5 | 5 | 5 | 4.75 | Good I/F | |
| | 1000 ppm citric acid to water | 50 µl (10%) | | | | | | | | Slightly cloudy | |
| | 15 ppm Product A to water | 3.75 µl (2%) | | | | | | | | water | |
| | 300 ppm WS 55 to water | 75 µl (2%) | | | | | | | | | |
| 5.19 | 25 ppm 2W158 to oil | 125 µl (2%) | 4 | 4.5 | 5 | 5 | 5 | 5 | 4.75 | Good I/F | |
| | 1000 ppm citric acid to water | 50 µl (10%) | | | | | | | | Slightly cloudy | |
| | 15 ppm Product A to water | 3.75 µl (2%) | | | | | | | | water | |
| | 300 ppm WS 55 to water | 75 µl (2%) | | | | | | | | | |

2W158 = Emulsion Breaker; available GE Betz

WS55 = corrosion inhibitor; available GE Betz

In runs 5.1-5.12 Products A & B affected the water drops at these very high (unrealistic) concentrations.

At these high concentrations, increased levels of about 20-30 2W158 were needed to completely resolve the emulsion.

NTA and EDTA did not affect the water drop. With 40 ppm active treated at water phase to control the crystal precipitate, it needed only 8 ppm of 2W158 to break out all the added water.

Conclusion: At typical treatment dosages (i.e., 15 ppm to the water) of Product A, no deleterious effect or desalter operation is seen.

Example 6

Additional tests using the procedure of Example 1 were undertaken. Results are reported in Table 6.

TABLE 6

| | Observations | |
|---|---|---|
| Treatment | Ambient Temperature | 100° C. After 1-1.5 hours |
| 6.1 100 ml of solution A: untreated | Clear water No precipitate | A lot of fine crystals precipitated on bottom (assumed 100%), the water is clear |
| 6.2 100 ml solution A 10 ppm Product A (50 µl of 2% in water) | Clear water No precipitate | Very few fine crystals on bottom (<1% compare to the blank) Clear water |
| 6.3 100 ml solution A 10 ppm Product A (50 µl of 2% in water) 200 ppm WS-55 (200 µl of 10% in water) | Cloudy water No precipitate | About 10% crystals stuck on wall and on bottom (compare to the blank). Cloudy water |
| 6.4 100 ml solution A 20 ppm Product A (100 µl of 2% in water) 200 ppm WS-55 (200 µl of 10% in water) | Cloudy water No precipitate | Very few fine crystals on bottom (<1% compare to the blank - same as # 2) Cloudy water |

Conclusion:

1. 200 ppm of WS-55 caused the cloudiness of the water. It also decreased the performance of Product A.
2. 20 ppm of Product A (instead of 10 ppm) resulted in the disappearance of the crystals in 100 ml the solution A, if 200 ppm of WS-55 was treated.

Example 7

Another series of tests using the protocol set forth in Example 1 were completed. Results are shown in Table 7.

TABLE 7

| | Observations | |
|---|---|---|
| Treatment | Ambient Temperature | 100° C. After 1-1.5 hours |
| 7.1 100 ml of solution A: untreated | Clear water No precipitate | A lot of fine crystals precipitated on bottom; the water is clear. |

TABLE 7-continued

| | Observations | |
|---|---|---|
| Treatment | Ambient Temperature | 100° C. After 1-1.5 hours |
| 7.2 100 ml solution A + 2.5 ppm Active Product A. | Clear water No precipitate | No precipitate observed, clear water. |
| 7.3 100 ml solution A + 5 ppm Active Product A. | Clear water No precipitate | No precipitate observed, clear water. |
| 7.4 100 ml solution A + 10 ppm Active Product A. | Clear water No precipitate | No precipitate observed, clear water. |
| 7.5 100 ml solution A + 2.5 ppm Active Product C. | Clear water No precipitate | No precipitate observed, clear water. |
| 7.6 100 ml solution A + 5 ppm Active Product C. | Clear water No precipitate | No precipitate observed, clear water. |
| 7.7 100 ml solution A + 10 ppm Active Product C. | Clear water No precipitate | No precipitate observed, clear water. |

Product C is acrylic acid/2-acrylamido-2-methylpropane-3-sulfonic acid mw ≈ 4,500.

It is noted that as used throughout the specification and ensuing claims when the liquid hydrocarbonaceous medium or aqueous medium is said to be contacted by an agent, this should not be narrowly construed to imply that the agent is added directly to the medium said to be contacted. Instead, the agent could be added to another medium or emulsion containing the intended medium provided that somewhere in the process, the agent, wherever its point of addition to the process may be, ultimately mixes with or contacts the intended medium.

While we have shown and described herein certain embodiments of the present invention, it is intended that there be covered as well any change or modification therein which may be made without departing from the spirit and scope of the invention as defined in the appended claims.

The invention claimed is:

1. A method for reducing calcium deposit formation along surfaces in contact with a water phase formed as a result of resolution of an emulsion from crude oil fed to a petroleum refinery desalter, wherein said crude oil has a high calcium content of 30 ppm calcium and greater, said method comprising:

a) contacting said crude oil with citric acid sequestrant and wash water thereby forming sequestered calcium citrate complexes in said water phase of said emulsion; and b) contacting said water phase with from about 1 to 300 ppm of a deposit control polymer to inhibit the formation of calcium based scales and deposits along said surfaces, wherein said deposit control polymer is AA/AHPSE, AA/APES, AA/APES/AHPSE, or AA/MA/APES.

2. Method as recited in claim 1 wherein said crude oil comprises about 100 ppm calcium and greater.

3. Method as recited in claim 1 wherein said deposit control polymer is AA/AHPSE.

4. Method as recited in claim 1 wherein said deposit control polymer is AA/APES.

5. A method for reducing calcium deposit formation along surfaces in contact with a water phase formed as a result of resolution of an emulsion from a crude oil fed to a petroleum refinery desalter, wherein said crude oil has a high calcium content of 30 ppm calcium and greater, said method comprising:

a) contacting said crude oil with citric acid sequestrant and wash water thereby forming sequestered calcium citrate complexes in said water phase of said emulsion; and b) contacting said water phase with from about 1 to 300 ppm of a deposit control polymer to inhibit the formation of calcium based scales and deposits along said surfaces, wherein said deposit control polymer is AA/AMPS.

6. Method as recited in claim 5 wherein said crude oil comprises about 100 ppm calcium and greater.

* * * * *